United States Patent [19]

Lohrberg et al.

[11] Patent Number: 4,839,013

[45] Date of Patent: Jun. 13, 1989

[54] ELECTRODE ASSEMBLY FOR GAS-FORMING ELECTROLYZERS

[75] Inventors: Karl Lohrberg, Heusenstamm; Peter Kohl, Neuberg, both of Fed. Rep. of Germany

[73] Assignee: Metallgesellschaft Aktiengesellschaft, Frankfurt am Main, Fed. Rep. of Germany

[21] Appl. No.: 107,181

[22] Filed: Oct. 9, 1987

[30] Foreign Application Priority Data

Nov. 27, 1986 [DE] Fed. Rep. of Germany ..... 3640584

[51] Int. Cl.[4] ..... C25B 9/00

[52] U.S. Cl. ..... 204/258; 204/266; 204/282; 204/283

[58] Field of Search ..... 204/256, 258, 266, 283, 204/282

[56] References Cited

U.S. PATENT DOCUMENTS 4,236,989 12/1980 Dahlburg ..... 204/283
4,474,612 10/1984 Lohrberg .
4,588,483 5/1986 Woodard, Jr. et al. ..... 204/283

FOREIGN PATENT DOCUMENTS 0170419 2/1986 European Pat. Off. .
1028153 5/1953 France .

*Primary Examiner*—John F. Niebling
*Assistant Examiner*—Kathryn Gorgos
*Attorney, Agent, or Firm*—Sprung Horn Kramer & Woods

[57] ABSTRACT

In an electrode assembly for gas-forming electrolyzers, particularly for monopolar membrane electrolyzers comprising vertical plate electrodes and opposite electrodes and a membrane between the plate electrode and the opposite electrode, the distribution of current in the membrane is improved and the voltage drop is decreased in that the plate electrodes are provided on that surface which faces the membrane with ante-electrodes, which consist of apertured, electrically conducting surface structures, which are electrically conductively connected to the plate electrodes and extend in planes which are parallel to the plate electrodes.

6 Claims, 2 Drawing Sheets

C-C

A-A

D-D

ELECTRODE ASSEMBLY FOR GAS-FORMING ELECTROLYZERS

BACKGROUND OF THE INVENTION

This invention relates to an electrode assembly for gas-forming electrolyzers, particularly for monopolar membrane electrolyzers comprising vertical plate electrodes and opposite electrodes and a membrane between the plate electrode and the opposite electrode.

In electrochemical processes it is important to achieve a uniform distribution of the current over the surface of the electrodes. The uniform distribution will depend on the throwing power of the electrolyte and on the homogeneity of the electrode. Whereas an inadequate throwing power can be compensated for by an increase of the interelectrode distance, this will increase the voltage drop across the cell. If the surface of the electrode is nonhomogeneous, the flow of current will result in local distortion. For this reason it is important to provide a uniform distance between the anode and cathode. In membrane electrolytic cells used for the commercial production of gases, such as chlorine, oxygen and hydrogen, the adjustment and maintenance of hydrogen and the adjustment and maintenance of a defined interelectrode distance involves a very high expenditure. If the interelectrode distance is too small, the gas bubbles cannot escape as quickly as is required. If the distance is large, the gas bubbles will escape quickly but the voltage across the cell will be higher owing to the higher resistance of the electrolyte. Cells are often proposed in which the interelectrode distance equals zero because the active anode structure and the anode/cathode structure are in direct contact with the membrane. In such cells, the membrane will have a shorter life because local current peaks cannot be avoided.

A presence of gas in the electrolyte between the electrodes will reduce the electrical conductivity of the electrolyte and will thus increase the energy consumption. The presence of such gas may also result in current-induced microdistortions on the surface of the electrodes. The evolution of gas will give rise to turbulence in the electrolyte. A turbulence in the electrolyte is undesirable because it will cause the membrane to be subjected to intense mechanical loads. To avoid a mechanical destruction of the membrane, it is generally necessary to limit the height of the electrodes, to provide a substantial distance between the electrodes in the cell, and to limit the electric current density, although this will reduce the energy efficiency of the electrolytic cell and its productivity.

In order to avoid the disadvantages of electrolytic cells comprising membranes and vertical electrodes, it is common to use apertured electrodes, i.e., electrodes having openings for the escape of the gases produced by the reaction. Such electrodes may consist, e.g., of perforated electrodes, woven wire mesh or expanded metal. The use of such electrodes will result in disadvantages residing, i.e., in a smaller active surface area, in inadequate mechanical stability and a loss of high-quality coating material on the rear side of the electrodes.

It is known from German Patent Publication No. 20 59 868 that gas-forming diaphragm cells comprising vertical electrodes may be provided with a plate electrode consisting of individual plates, which have surfaces for guiding the gas which has been produced and is to be removed. In the electrolyzer known from French Patent Specification No. 10 28 153, the electrodes are parallel to each other and have the smallest possible spacing. The known electrodes each consist of one plate or a plurality of plates. The plates have horizontal slots, which are defined by edge flanges of the plate strips and present the smallest possible resistance to the escape of gas. The edge flanges are directed toward the opposite electrode and the active surface area is not substantially decreased.

Published European Patent Application No. 102,099 discloses an electrode assembly for gas-producing electrolyzers comprising electrode plates which are divided along a plurality of continuous horizontal lines. A certain geometry has been adopted to promote the escape of gas from the electrolyte.

The electrodes of electrolytic cells are ideally used also to conduct electric current. That use will not give rise to problems in bipolar cells, where the current flows through the electrode in the direction of the electrolysis current so that an adequate cross-sectional area for the flow of the current will always be available. On the other hand, in monopolar cells the current in the electrode must flow transversely to the electrolysis current. Whereas surface electrodes can be used for that purpose, it is not possible to readily use wire netting and expanded metal, particularly in electrolytic cells which differ from diaphragm cells in that they operate at current densities above 3 $kA/m^2$. In that case it is usual to conduct the current by internal elements, such as conductor rods, from which the current is distributed over the active surfaces of the electrodes (Published German Application No. 28 21 984).

In the electrolysis of aqueous solutions of alkali chloride by a membrane process using non-selective membranes, the ion-selective membrane contacts the anode sheet structures owing to the different densities of the alkali hydroxide in the cathode compartment and the acid aqueous alkali chloride solution in the anode compartment. Because the electrolyte is absent from or present only in a very small quantity at said contact surface of the membrane, no electrolysis or only a very weak electrolysis can take place at said contact surface. For this purpose, expanded metal, perforated plates or similar electrode plates of titanium are used for commercial electrolysis so that an electrolysis can take place at the edges of the holes or of the expanded metal and in part also on the rear of the electrode plates. But this involves a loss of active electrode surface area so that an undesirable voltage rise results.

SUMMARY OF THE INVENTION

It is an object of the invention to avoid or reduce such voltage losses and to permit the flow of high electrolysis currents. In an electrode assembly for gas-forming electrolyzers, particularly for monopolar membrane electrolyzers comprising vertical plate electrodes and opposite electrodes and a membrane between the plate electrode and the opposite electrode, that object is accomplished in accordance with the invention in that an electrode assembly of the kind described is designed and improved in that the plate electrodes are provided on that surface which faces the membrane with ante-electrodes, which consist of apertured, electrically conducting surface structures, which are electrically conductively connected to the plate electrodes and extend in planes which are parallel to the plate electrodes.

In the assembly in accordance with the invention a predetermined distance between the membrane and the plate anode is reliably maintained, and a filling of the space between the membrane and the plate surface with electrolyte is ensured. The ante-electrode consisting of the apertured surface structure carried the ion-selective membrane. The plate electrode, which has a high electrical conductivity, permits a flow of high electrolysis current and takes part in the electrolysis with that surface area which faces the apertured surface structure (ante-electrode). Besides, the membrane also takes part in the electrolytic process on that surface area which in conventional arrays is inactive owing to the required perforations in the membrane. Moreover, gas can effectively escape from the electrolyte-gas suspension.

The vertical plate anode may consist in a known manner of titanium strips, which are flanged in a specific manner and provided with means for guiding escaping gas, as is described in Published European Patent Application No. 102,099. The several metal strips are entirely separated from each other by continuous horizontal gaps.

In another embodiment of the invention, the plate electrode which carries the apertured surface structure may be divided along vertical or vertical and horizontal lines into a plurality of completely separate units. Membrane electrolytic cells which have such an electrode structure and in which the electrode having one polarity is divided into a plurality of horizontal units along horizontal lines and the electrode having the opposite polarity is divided into a plurality of separate units along vertical lines are known from Published European Patent Application No. 97,991.

The apertured surface structures or ante-electrodes are spaced 1 to 5 mm from the plate electrode and attached to the latter. That distance preferably amounts to 1.5 to 2.5 mm. The apertured surface structures are usually joined by spot-welding to bosses or humps of the plate electrode. The spacing and number of the humps and spot welds will be selected in consideration of the requirements imposed by the current loading. It will be understood that all other conventional joining methods may also be used.

The electrically conducting, apertured metallic surface structure is usually resilient and flexible and has a thickness of about 0.5 to 2 mm and may consist, e.g., of perforated sheet metal (sieve plate), expanded metal or wire mesh, e.g., woven wire mesh or wire netting. Alternatively, the apertured surface structure may consist of a system of individual wires, which extend in a plane substantially parallel to the electrode plate and are conductively joined to the plate electrode by spot welding. The several wires may be parallel or extend at an angle to each other so that square or diamond like meshes result.

In 1 known manner, the selection of the structural material for the electrode assembly in accordance with the invention for monopolar electrolyzers will depend on whether the electrode assembly is to be used as an anode or cathode. If the electrode assembly consisting of plate electrodes and ante-electrodes consisting of an apertured surface structure that is conductively connected to the plate electrode is used as an anode in the electrolysis of aqueous alkali chloride solutions, the plate electrode and the ante-electrode may consist, e.g., of titanium, zirconium, niobium, tantalum or their alloys. For use as a cathode the ante-electrode and the plate electrode may consist, e.g., of fine steel, nickel or of steel clad with said metals.

The electrode assembly in accordance with the invention is firmly installed in a known manner in a frame which is provided with terminals for feeding electric current. An activating coating is provided on the plate electrode only on that surface which faces the opposite electrode. That coating consists in a known manner, e.g., of metal oxide and metals of the group consisting of platinum, iridium, osmium, palladium, rhodium, ruthenium.

The electrode assembly in accordance with the invention is used in monopolar electrolyzers provided with a membrane. In connection with the invention the term membrane cell is used only for cells having ion-selective membranes, such as cationic perfluorinated membranes. Such membranes permit a separation of the cathodic and anodic product of an electrolysis from each other or from the reactants supplied to the opposite electrode.

A number of advantages are afforded by the electrode assembly in accordance with the invention. The ion-selective membrane is kept at the desired constant distance from the plate electrode in a simple and reliable manner. Because the apertured ante-electrode is active at the edges of the apertures and the plate electrode is active on the projected areas of the apertures, the current will be more uniformly distributed in the membrane than where only apertured electrodes are used. Owing to the geometry employed, an improved escape of gas from the gas-electrolyte suspension and an improved exchange of electrolyte in the space between the apertured electrode and the plate electrode will be achieved. The use of the assembly in accordance with the invention will also permit a decrease of the voltage drop. In membrane cells having ion-selective membranes the K value can be decreased by as much as 0.05 volt.$m^2$/kA. In case of a current of 4 kA/$m^2$, this corresponds to a voltage gain of 200 mV.

The electrode assembly in accordance with the invention is shown more in detail and by way of example in the drawings wherein:

DETAILED DESCRIPTION OF THE INVENTION

Figure 1:
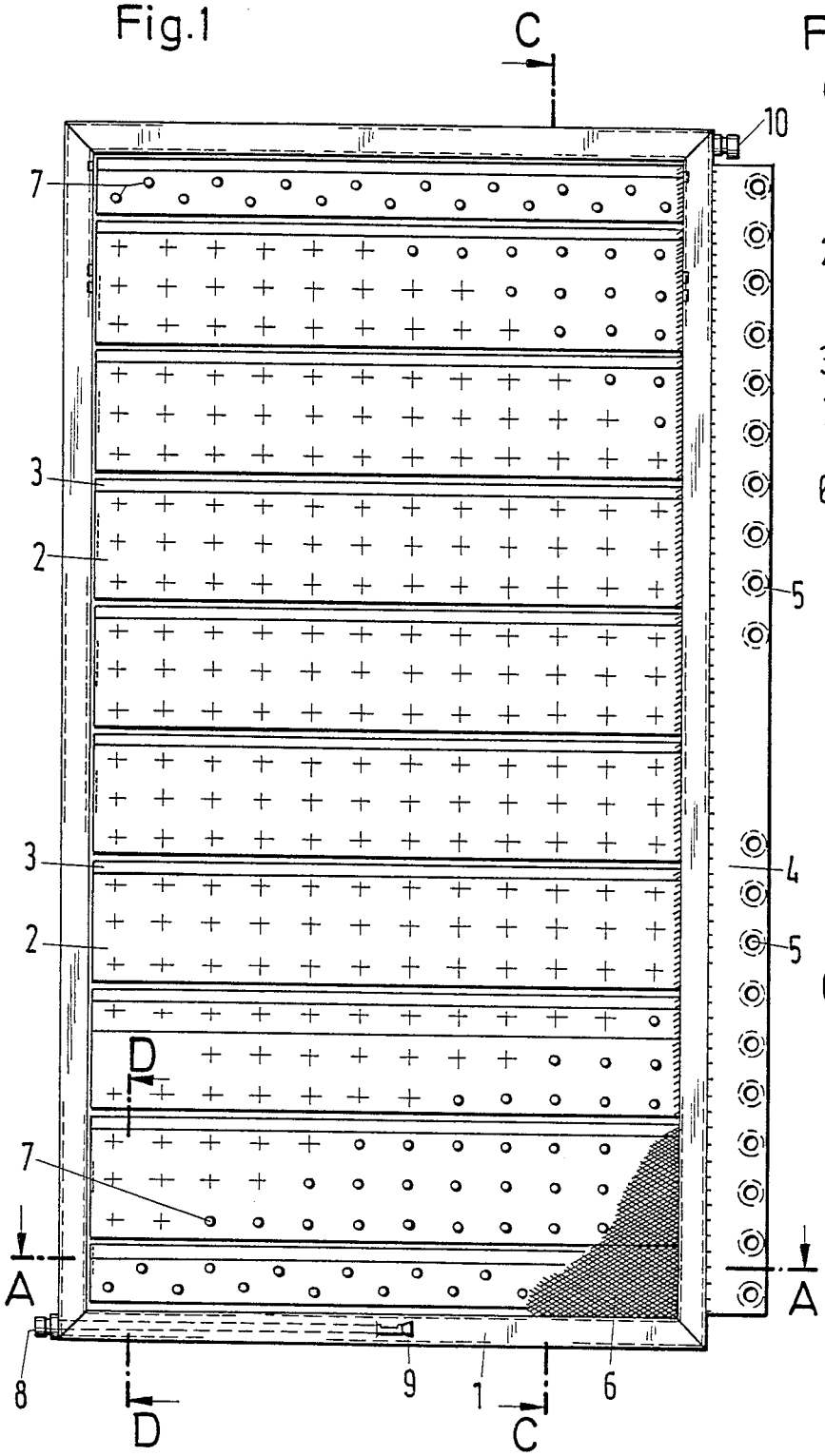
FIG. 1 is a vertical sectional view showing the electrode according to the invention.
Figure 2:
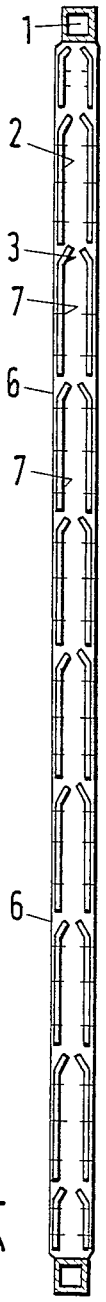
FIG. 2 is a vertical sectional view taken on line C—C in FIG. 1 and showing the electrode assembly. Identical parts are designated by the same reference characters in FIGS. 1 and 2.

Referring now to FIGS. 1 and 2, frame 1 carries plate electrodes 2, which consist of strips that are separated along continuous horizontal lines and have top edge flanges for deflecting the evolved gases behind the active electrode surface. The electrolyte is introduced into the frame 1 at 8 through a perforate tube, which has been squeezed at its end 9. The electrolyte enters the interior of the cell from the frame 1 through openings 11 (FIG. 3) and leaves the cell through an outlet opening 10. The frame 1 is laterally extended by the provision of a rail 4, which has openings 5 for receiving lines for connection to electric power sources. The ante-electrode 6 consisting of an expanded metal surface structure is electrically conductively connected to the plate electrode strips by a number of tack welds 7.

Figure 3:
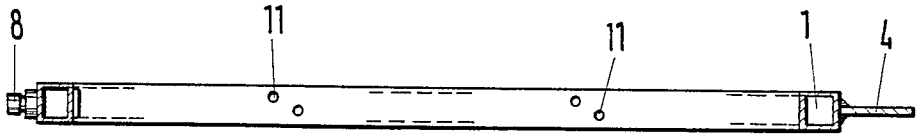
FIG. 3 is a sectional view taken on line A—A in FIG. 1.

As shown in FIG. 3, the lower horizontal bar of the frame 1 is formed with openings 11, through which the electrolyte enters the interior of the cell.

Figure 4:
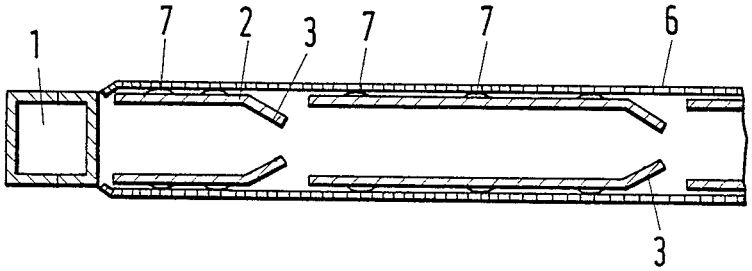
FIG. 4 is a sectional view taken on line D—D in FIG. 1 and showing the electrode assembly.

As shown in FIG. 4, the striplike plate electrodes 2 have top edge flanges 3 and are joined by spot welds 7 to the ante-electrode 6.

The invention will be explained more in detail and by way of example with reference to an embodiment of a membrane electrolytic cell equipped in accordance with the invention.

A test cell having an ion-selective membrane (Nafion® 90209 of E. I. du Pont de Nemours & Co. Inc.) was used for measurements using conventional apertures anode structures in comparison with an electrode assembly in accordance with the invention. The conventional apertured electrode consisted of expanded metal ($RuO_2$-activated titanium) having an open area of 20%. The electrolytic cell had a total height of 300 mm and a depth of 200 mm. The electrode assembly in accordance with the invention consisted of an ante-electrode made from the same expanded metal ($RuO_2$-activated titanium). Vertically extending titanium wires were used to electrically connect the ante-electrode and the plate electrode and to maintain a distance of 3 mm between said electrodes. The opposite electrodes consisted of unactivated expanded nickel metal. The interelectrode distance between the ante-electrode and the opposite electrode amounted to 4 mm. The membrane was in contact with the ante-electrode. The electrolyte was at a temperature of 70° to 80° C. The catholyte consisted of sodium hydroxide solution having a concentration of 32%. The brine contained 310 g NaCl/l and the anolyte contained 200 g NaCl/l.

The following voltage gains in favor of the electrode assembly in accordance with the invention were found:

| i | (kA/M²) | 1 | 2 | 3 | 4 |
|---|---|---|---|---|---|
| U | (Mv) | 40 | 90 | 135 | 180 |

That result means a considerable saving. If it is assumed that electric power costs 0.10 DM/kWh, the voltage gain measured at 4 kA/m² in an electrolyzing plant having a rated capacity of 300,000 day-kg NaOH would correspond to an annual saving of 1.37 million deutschmarks.

What is claimed is:

1. An electrode assembly for a gas-forming monopolar membrane electrolyzer, said assembly comprising: a frame, at least one anode, at least one cathode, an ion-selective membrane between the anode and cathode, wherein the anode and cathode each comprises a vertical plate electrode and an ante-electrode electrically conductively connected at many points to the plate electrode, wherein said plate electrode is composed of platelike metal strips with gaps between the strips, wherein said strips are electrically conductively fastened to the frame, wherein the surface of the plate electrode which faces the membrane has an activating coating to activate electrolysis, wherein said ante-electrode is at the surface of the plate electrode facing the membrane, wherein said ante-electrode is a vertical, planar, electrically conducting screenlike or sievelike metal structure covering at least one surface of the plate electrode and the distance between the plate electrode and the ante-electrode fastened thereto is 1–5 mm.

2. An electrode assembly according to claim 1, wherein each planar structure consists of one of perforated sheet metal, expanded metal, woven wire mesh, wire netting or individual wires.

3. An electrode assembly according to claim 1, further comprising a plurality of anodes and cathodes divided into a plurality of separate units along continuous horizontal lines.

4. An electrode assembly according to claim 1, further comprising a plurality of anodes and cathodes divided into a plurality of separate units along continuous vertical lines.

5. An electrode assembly according to claim 1, further comprising a plurality of anodes divided into a plurality of separate units along horizontal lines and a plurality of cathodes divided into a plurality of separate units along vertical lines.

6. An electrode assembly according to claim 1, wherein the planar structures are spaced apart by a distance from 1.5 to 2.5 mm.

* * * * *